US005121974A

United States Patent [19]

Monson

[11] Patent Number: 5,121,974

[45] Date of Patent: Jun. 16, 1992

[54] COMPUTER DESK APPARATUS

[76] Inventor: Alan R. Monson, P.O. Box 52, Corvallis, Oreg. 97339

[21] Appl. No.: 699,573

[22] Filed: May 14, 1991

[51] Int. Cl.[5] ..... A47B 17/00

[52] U.S. Cl. ..... 312/194; 312/297; 160/113; 160/236

[58] Field of Search ..... 312/194, 239, 297, 311; 160/236, 201, 113, 118

[56] References Cited

U.S. PATENT DOCUMENTS

| | | | |
|---|---|---|---|
| 242,436 | 6/1881 | Cutler | 312/196 X |
| 656,556 | 8/1900 | Lind | 312/297 X |
| 798,634 | 9/1905 | Stevens | 312/297 X |
| 4,279,454 | 7/1981 | Koiso et al. | 312/297 |
| 4,632,471 | 12/1986 | Visnapuu | 312/7.2 X |
| 4,696,522 | 9/1987 | Lowe | 312/297 |

FOREIGN PATENT DOCUMENTS

| | | | |
|---|---|---|---|
| 621855 | 5/1927 | France | 312/297 |

*Primary Examiner*—Kenneth J. Dorner
*Assistant Examiner*—Brian K. Green
*Attorney, Agent, or Firm*—Leon Gilden

[57] ABSTRACT

A desk structure provided with parallel walls formed with a front wall defining a central cavity, with the central cavity positioned between a right series of storage drawers, and a left storage door positioned hingedly in front of a printer cavity, wherein the printer cavity includes a medially positioned slide-out drawer, the slide-out drawer defining a gap between a rear portion of the slide-out drawer and a rear wall of the structure. Extending upwardly from a lower desk plate are right and left storage shelves, with a medial upper cavity mounted therebetween, with the upper cavity including a roll-top member directed over the cavity to provide protection for the organization when not in use. A modification of the invention includes a further roll-top member formed of transparent polarized slats minimizing glare relative to a computer monitor positioned within the cavity.

1 Claim, 4 Drawing Sheets

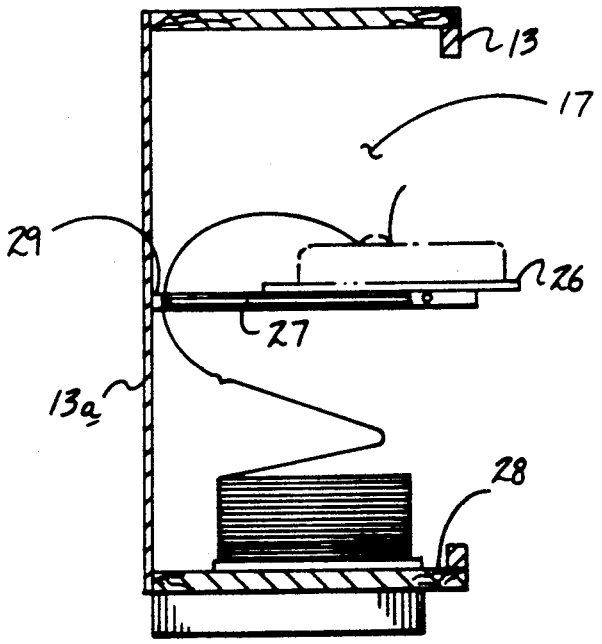
Fig 4
Fig 5
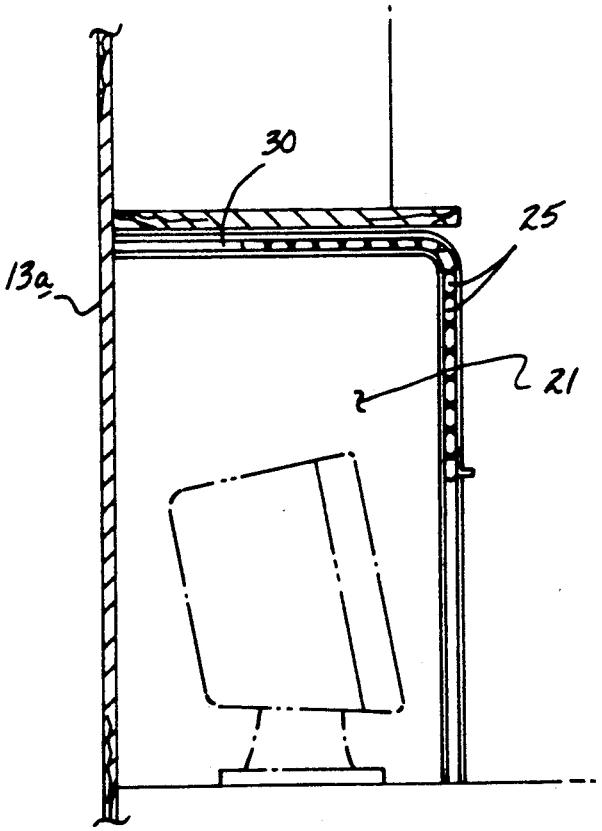

COMPUTER DESK APPARATUS

BACKGROUND OF THE INVENTION

1. Field of the Invention

Various storage organizations have been utilized for housing components since the computer usage. The instant invention attempts to provide a new and improved computer desk apparatus wherein the same is arranged for the convenient and efficient positioning of computer components relative to an individual.

2. Description of the Prior Art

Various work table structure has been utilized in the prior art for properly and conveniently orienting components such as computers and the like relative to an operator. Typically such devices are positioned about a surface of a work table utilizing accessory items such as lamps, paper racks, and the like. With the use of prior art work tables, support shelving must be positioned either adjacent a table or rearwardly of an operator, wherein convenience for access of such shelving is limited.

A singular purpose of the invention is to provide an orientation of construction about an operator, wherein the various components for use in a work station such as computers, telephones, shelving and the like is positioned within a working operative spacing relative to an operator. Prior art devices for such construction are exemplified in U.S. Pat. No. 4,145,097 to Naess, et al. wherein a data terminal member utilizes a planar support surface mounting a keyboard under the table medially of an operator.

U.S. Pat. No. 4,612,863 to Vonhausen, et al. sets forth a work table utilizing various pivotally mounted pedestals for use relative to an operator.

As such, it may be appreciated that there continues to be a need for a new and improved computer desk apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of desk apparatus now present in the prior art, the present invention provides a computer desk apparatus wherein the same sets forth in a convenient and operative manner various storage and operative components relative to an operator. As such, the general purpose of the present invention, which will be described subsequently in greater detail, is to provide a new and improved computer desk apparatus which has all the advantages of the prior art desk apparatus and none of the disadvantages.

To attain this, the present invention provides a desk structure with parallel walls formed with a front wall defining a central cavity, with the central cavity positioned between a right series of storage drawers, and a left storage door positioned hingedly in front of a printer cavity, wherein the printer cavity includes a medially positioned slide-out drawer, the slide-out drawer defining a gap between a rear portion of the slide-out drawer and a rear wall of the structure. Extending upwardly froma lower desk plate are right and left storage shelves, with a medial upper cavity mounted therebetween, with the upper cavity including a roll-top member directed over the cavity to provide protection for the organization when not in use. A modification of the invention includes a further roll-top member formed of transparent polarized slats minimizing glare relative to a computer monitor positioned within the cavity.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreiated that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is another object of the present invention to provide a new and improved computer desk apparatus which may be easily and efficiently manufactured and marketed.

It is a further object of the present invention to provide a new and improved computer desk apparatus which is of a durable and reliable construction.

An even further object of the present invention is to provide a new and improved computer desk apparatus which is susceptible of a low cost of manufacture with regard to both materials and labor, and which accordingly is then susceptible of low prices of sale to the consuming public, thereby making such computer desk apparatus economically available to the buying public.

Still yet another object of the present invention is to provide a new and improved computer desk apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is an orthographic view, taken along the lines 4—4 of FIG. 2 in the direction indicated by the arrows.

FIG. 5 is an orthographic view, taken along the lines 5—5 of FIG. 2 in the direction indicated by the arrows.

DESCRIPTION OF THE PREFERRED EMBODIMENT

Figure 1:
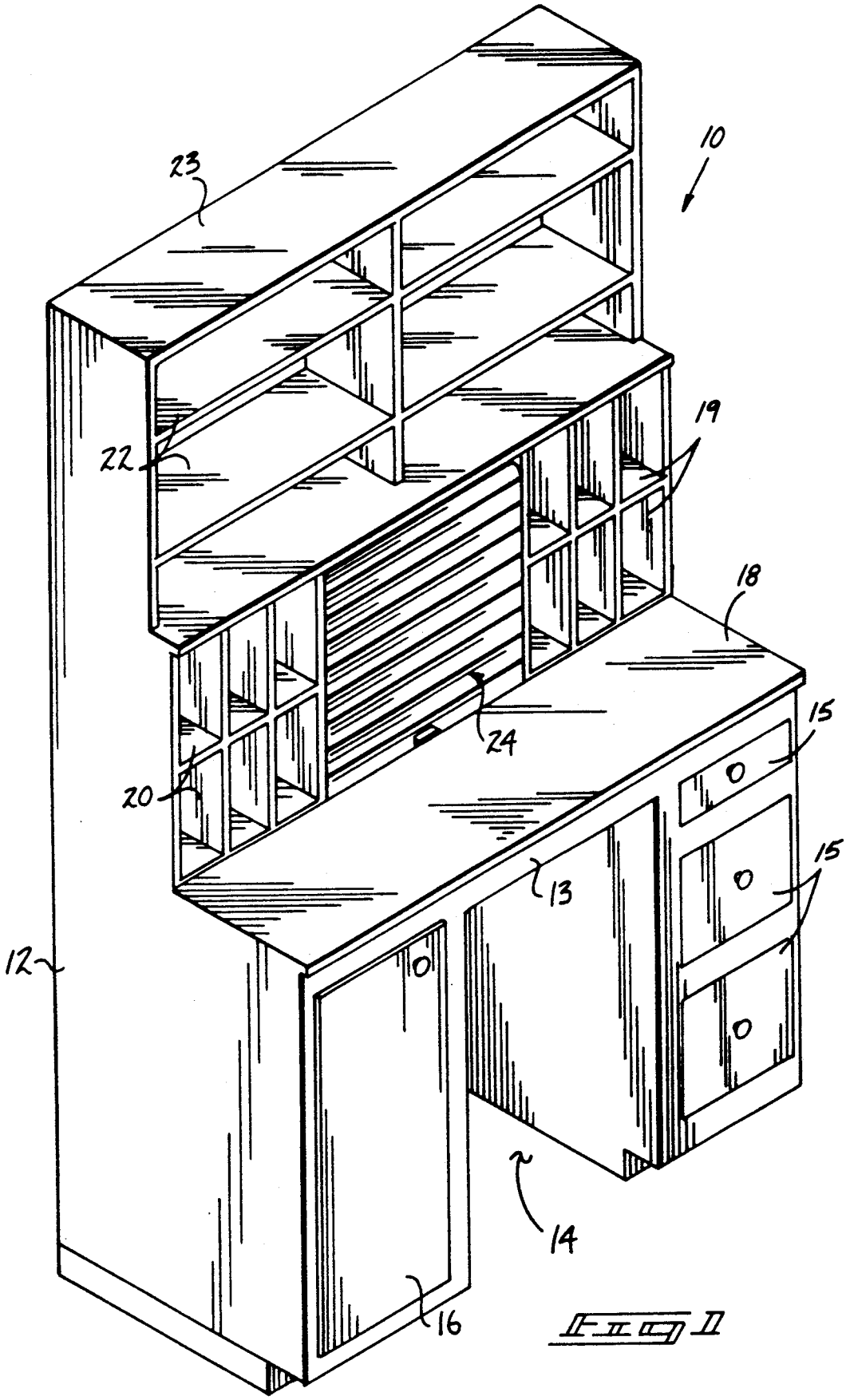
FIG. 1 is an isometric illustration of the instant invention.
Figure 2:
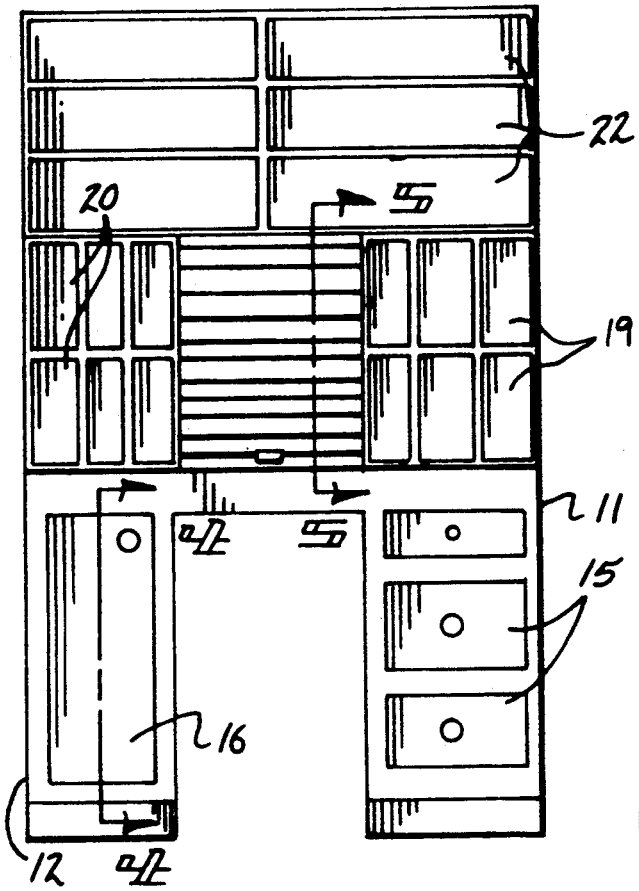
FIG. 2 is an orthographic front view, taken in elevation, of the instant invention.
Figure 3:
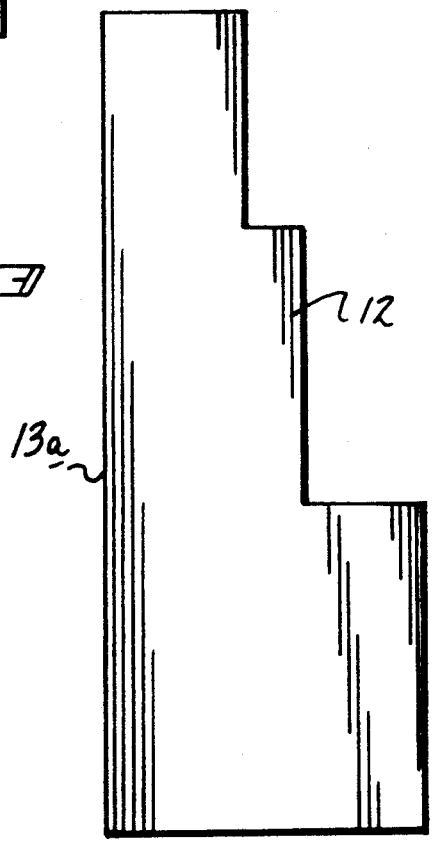
FIG. 3 is an orthographic side view, taken in elevation, of the instant invention.

With reference now to the drawings, and in particular to FIGS. 1 to 6 thereof, a new and improved computer desk apparatus embodying the principles and concepts of the present invention and generally designated by the reference numeral 10 will be described.

More specifically, the computer desk apparatus 10 of the instant invention essentially comprises a structure including a right "L" shaped side wall 11 spaced from, parallel to, and coextensive with a left "L" shaped side wall 12. A front wall 13 is orthogonally and integrally mounted to the forward edges of the right and left walls 11 and 12, wherein a first planar support surface 18 orthogonally mounted and contiguous relative to the front wall 13 is provided. The front wall 13 is spaced from and parallel a rear wall 13*a*, wherein the rear wall 13*a* extends a predetermined first length greater than a predetermined second length defined by the front wall 13.

The front wall 13 includes a central leg cavity 14 positioned medially of the front wall and extending therethrough, defining a series of right storage drawers 15 directed through the front wall adjacent the right "L" shaped side wall 11. A left storage door 16 hingedly mounted to the front wall 13 positioned adjacent the left side wall 12 includes a left storage drawer cavity 17 between the front wall 13 and the rear wall 13*a* (see FIG. 4). The left storage cavity 17 includes a plurality of rail members 27 positioned medially of the cavity mounted to sides of the cavity slidably mounting a slide shelf 26 thereon. The slide shelf 26 is arranged for positioning a computer printer thereon. The left storage cavity 17 further includes a left storage cavity floor 28 parallel to and below the slide shelf 26 mounting a predetermined quantity of endless printer paper thereon. Further. a gap 29 is provided between the slide shelf 26 and the rear wall 13*a* for directing of the endless paper through the gap to the printer from the paper supply.

Positioned rearwardly of and extending orthogonally upwardly from the first planar support surface 18 are a respective right and left matrix of lower storage cavities 19 and 20 positioned to either side of a central storage cavity 21. Each of the lower storage cavities 19 and 20 include a plurality of parallel horizontal rows of storage cavities for positioning paper, stationery components, and writing instruments associated with computer usage. The desk apparatus 10 further includes a plurality of parallel rows of upper storage cavities 22 positioned above the central storage cavity 21 and the right and left storage cavities 19 and 20 defined by parallel rows of upper storage cavities coextensively directed between the right and left side walls 11 and 12. A top support plate 23 is orthogonally mounted to upper terminal ends of the right and left "L" shaped side walls 11 and 12 coextensive with the upper storage cavities 22.

The central storage cavity 21 includes a first roll-top cover 24 that is formed of a series of parallel and coextensive slats 25 that are hingedly mounted to one another in a side-to-side relationship. The parallel slats 25 are mounted within spaced parallel "L" shaped first tracks 30. The "L" shaped first tracks extend above and forwardly of the central storage cavity 21 to define the "L" shaped configuration. A first lift handle 32 is mounted to a lowermost slat of the parallel slats 25 to permit and enhance manual manipulation of the slats to cover or uncover access to the central storage cavity 21.

Figure 6:
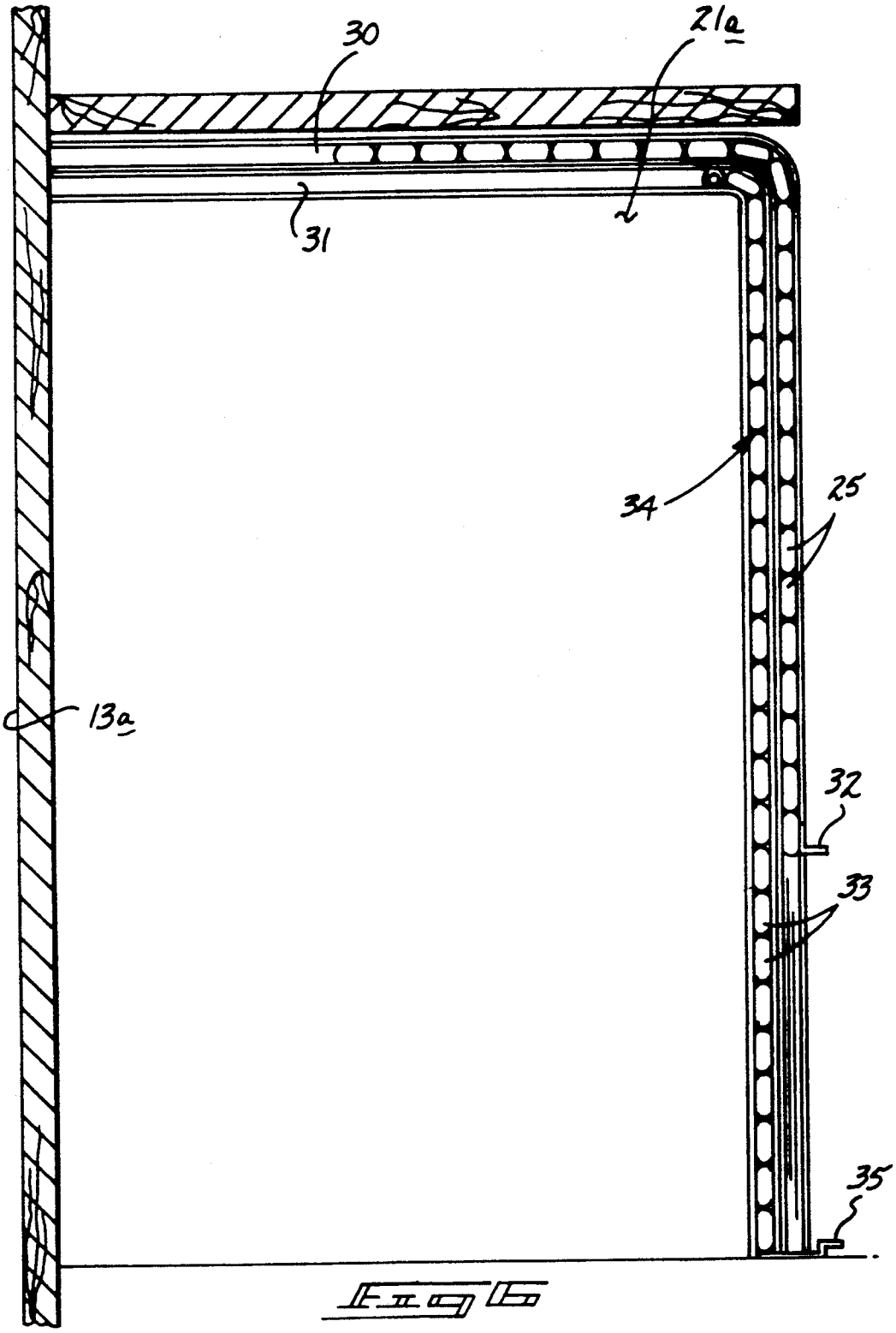
FIG. 6 is an orthographic cross-sectional illustration of a modified central storage cavity of the type as set forth in FIG. 5.

FIG. 6 illustrates a modified central storage cavity 21*a*, with spaced parallel "L" shaped second tracks 32 arranged parallel to the first "L" shaped tracks 30 and are provided to slidably mount a second roll-top cover 34 formed of spaced parallel polarized transparent slats 33 to prevent glare in use of a computer monitor when positioned within the central cavity 21, as illustrated in FIG. 5. The polarized transparent slots 33 are also hingedly connected relative to one another in a side-to-side relationship and include a second left handle 35 mounted at a lowermost terminal end of the transparent slats 33. In this manner, a user may selectively direct the second roll-top cover 34 to enhance ease of prolonged usage of a computer monitor.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A computer desk apparatus. comprising in combination, a unitary cabinet housing, including a right "L" shaped side wall spaced from, parallel, and coextensive with a left "L" shaped side wall, and a front wall orthogonally mounted to a forward portion of the right and left side walls, with the front wall spaced from and parallel a rear wall, and the front wall including a central leg cavity, the central cavity oriented adjacent a plurality of storage drawers mounted to the front wall adjacent the right side wall, and further including a left storage door mounted to the front wall adjacent the left side wall, and the left storage door positioned forwardly of a left storage cavity that extends between the front wall and the rear wall, and the left storage cavity including a medially positioned slide shelf, and a plurality of rail members, the slide shelf mounted within a plurality of rail members, and the slide shelf defining a gap between a rear edge of the slide shelf and the rear wall, and a left storage cavity floor positioned below the rail members within the left storage cavity, and a first planar support surface mounted orthogonally between the right and left "L" shaped side walls and contiguous with the front wall, and a central storage cavity mounted orthogonally relative to the first planar support surface between the first planar support surface and the rear wall, and a right matrix of lower storage cavities mounted between the first planar support surface and the rear wall adjacent the right side wall, and a left matrix of lower storage cavities positioned between the central cavity and the left "L" shaped side wall, and a plurality of parallel rows of upper storage cavities mounted coextensively between the right and left "L" shaped side walls above the central storage cavity, and wherein the central storage cavity includes a plurality of first "L" shaped tracks, the "L" shaped tracks slidably mounting a first roll-top cover, the first roll-top cover comprising a plurality of parallel slats, each slat hingedly interconnected in a side-to-side relationship coextensive with one another, and a first lift handle mounted to a lowermost slat of the parallel slats, wherein the parallel slats are slidably mounted within the first "L" shaped tracks, and including a plurality of second "L" shaped tracks, the second "L" shaped tracks arranged parallel relative to the first "L" shaped tracks within the central storage cavity, and the second "L" shaped tracks including a second roll-top cover slidably mounted therebetween, the second roll-top cover including spaced parallel polarized transparent slats, the spaced parallel polarized transparent slats including a lowermost transparent slat, wherein the lowermost transparent slat includes a second lift handle mounted thereto for manual manipulation of the second roll-top cover, and the polarized transparent slats are coextensive relative to one another and are hingedly mounted in a side-to-side relationship, with the second roll-top cover oriented parallel relative to the first roll-top cover.

* * * * *